US007030686B2

(12) United States Patent
Itoh

(10) Patent No.: US 7,030,686 B2
(45) Date of Patent: Apr. 18, 2006

(54) CONSTANT VOLTAGE CIRCUIT WITH PHASE COMPENSATION

(75) Inventor: Kohzoh Itoh, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/532,220

(22) PCT Filed: Aug. 27, 2004

(86) PCT No.: PCT/JP2004/012779

§ 371 (c)(1),
(2), (4) Date: Jul. 5, 2005

(87) PCT Pub. No.: WO2005/022283

PCT Pub. Date: Mar. 10, 2005

(65) Prior Publication Data

US 2005/0248391 A1 Nov. 10, 2005

(30) Foreign Application Priority Data

Aug. 29, 2003 (JP) ..... 2003-306456
Oct. 2, 2003 (JP) ..... 2003-344523

(51) Int. Cl.
*G05F 1/10* (2006.01)

(52) U.S. Cl. ..... 327/541; 327/540; 323/316

(58) Field of Classification Search ..... 327/539, 327/540, 541, 543; 323/313, 316
See application file for complete search history.

(56) References Cited

U.S. PATENT DOCUMENTS

| | | | | |
|---|---|---|---|---|
| 5,867,015 | A * | 2/1999 | Corsi et al. | 323/316 |
| 5,892,402 | A | 4/1999 | Tsubaki et al. | |
| 6,114,843 | A * | 9/2000 | Olah | 323/280 |
| 6,191,994 | B1 * | 2/2001 | Ooishi | 365/226 |
| 6,563,371 | B1 * | 5/2003 | Buckley et al. | 327/539 |
| 6,570,371 | B1 * | 5/2003 | Volk | 323/315 |
| 6,570,436 | B1 * | 5/2003 | Kronmueller et al. | 327/538 |
| 2003/0020446 | A1 | 1/2003 | Viehmann | |

FOREIGN PATENT DOCUMENTS

| | | |
|---|---|---|
| JP | 5-250055 A | 9/1993 |
| JP | 10-257764 | 9/1998 |
| JP | 2002-032133 | 1/2002 |
| JP | 2002-091580 | 3/2002 |
| JP | 2003-177828 | 6/2003 |

* cited by examiner

*Primary Examiner*—Terry D. Cunningham
(74) *Attorney, Agent, or Firm*—Dickstein Shapiro Morin & Oshinsky LLP

(57) ABSTRACT

A constant-voltage circuit uses a capacitor having a low ESR (equivalent serial resistance), such as a ceramic capacitor, for phase compensation, wherein a voltage drop of an output voltage due to a resistance provided for optimizing the phase compensation is compensated for by providing output current to an output a current proportional to an voltage detecting resistance through a current mirror circuit thereby the voltage drop of the output voltage is compensated for.

15 Claims, 5 Drawing Sheets

CONSTANT VOLTAGE CIRCUIT WITH PHASE COMPENSATION

TECHNICAL FIELD

The present invention generally relates to a constant-voltage circuit, and especially relates to a constant-voltage circuit that is capable of performing phase compensation using a low ESR (Equivalent Serial Resistance) capacitor by providing a circuit for compensating for a voltage drop of an output voltage caused by an output resistance.

BACKGROUND ART

Conventionally, a power unit that is capable of compensating for a voltage drop at a load due to wiring without using two remote sensing lines for low cost has been available, for example, as disclosed by Patent Reference 1.

Further, in order to perform phase compensation for a constant-voltage circuit, conventionally, a capacitor is often provided at the output terminal of the constant-voltage circuit in parallel to the load as shown in FIG. 3. An internal impedance of ESR and a capacitance of a capacitor C101 provide the phase compensation, and improve the frequency characteristics of the constant-voltage circuit by moving a pole and generating a zero point in the frequency characteristics. Since the advantage of this method is that the constant-voltage circuit does not have to provide a terminal for phase compensation, the number of terminals of a power supply IC can be small. For such phase compensation method, a tantalum capacitor having a great ESR is normally used.

As shown in FIG. 4, the typical ESR of a tantalum capacitor having a capacitance of 2.2 μF ranges from 1 Ω to 10 Ω, which ESR provides the zero point at a desirable region in the frequency characteristics of the constant-voltage circuit for phase compensation, and accordingly, satisfactory phase compensation is available. Nevertheless, recently and continuing, ceramic capacitors that are smaller and lighter-weight than tantalum capacitors, having a large capacitance, are available with a stable supply at low cost. Accordingly, requirements for using the ceramic capacitor as the capacitor for the phase compensation are increasing.

Here, the ESR of the ceramic capacitor is small, ranging from 10 mΩ to 30 mΩ, which is 100 to 1000 times smaller than the tantalum capacitor as shown in FIG. 5. Accordingly, when the ceramic capacitor is used for phase compensation, the frequency at which a zero point is obtained moves to a very high frequency, and suitable phase compensation cannot be obtained.

In order to lower the frequency at which the zero point is obtained, a solution may be to insert a resistor in series with the ceramic capacitor, the resister being provided outside of a power supply IC (constant voltage IC). However, it is disadvantageous for space and cost reasons. Accordingly, it is preferred that the resistor be provided inside the power supply IC.

FIG. 6 and FIG. 7 show examples of a circuit where a resistor is provided in the power supply IC.

The example shown in FIG. 6 includes a terminal PinVout2, which is an IC package terminal, for connecting a ceramic capacitor, a fixed resistor R103 having a resistance value of about 100 mΩ for phase compensation provided between a pad ICP2 of the IC chip and the terminal PinVout2, and an output terminal PinVout1 for outputting a voltage. In a case like this, since the output current io does not flow through the fixed resistor R103, the output voltage is stably available.

In the case of the example shown in FIG. 7, the resistance value of the fixed resistor R103 for phase compensation ranges from 100 mΩ to 10 Ω, the resistor R103 being provided between a pad ICP of the IC chip and the output terminal PinVout of the IC.

While in the case of the example shown in FIG. 7, the number of IC terminals is smaller than the example of FIG. 6, the output current io flows through the fixed resistor R103. When the output current io becomes great, a voltage drop Vdrop (=io×resistance of R103) across the fixed resistor R103 cannot be neglected. In order to compensate for the voltage drop Vdrop, a resistor R104 having a fixed resistance value is inserted between a reference voltage source Vref and the grounding voltage, a load is connected between the output terminal PinVout and the resistor R104, and the same output current io flows through the fixed resistor R104 and the load.

According to this arrangement, if the output current io increases, a voltage drop across the fixed resistor R104 increases, and a voltage of the non-inverted input terminal of an error amplifying circuit AMP into which the reference voltage Vref is input rises. For this reason, an internal output voltage Vo of the constant-voltage circuit is raised, and the voltage drop Vdrop due to the fixed resistor R103 is compensated for. In order to completely remove the influence of the fixed resistor R103, relations between resistors R101 and R102 for output voltage detection, and the fixed resistors R103 and R104 are set as (resistance of *R*101)/(resistance of *R*102)=(resistance of *R*103)/(resistance of *R*104).

However, if (resistance of R101)/(resistance of R102)< (resistance of R103)/(resistance of R104), positive feedback starts occurring, and the output voltage rises. Accordingly, the relations are usually made into (resistance of *R*101)/(resistance of *R*102)>=(resistance of *R*103)/(resistance of *R*104).

[Patent Reference 1]. JPA 10-257764

DESCRIPTION OF THE INVENTION

PROBLEM(S) TO BE SOLVED BY THE INVENTION

As described above, the example shown in FIG. 6 has a problem in that an additional IC terminal is required as compared with the example shown in FIG. 7, which problem becomes real when an IC has a limit to the number of terminals. As for the example shown in FIG. 7, since the fixed resistor R104 is inserted between the load and the grounding voltage, the low end voltage of the load, which is connected to the resistor R104, is not equal to the ground voltage, which poses a problem when transmitting/receiving a signal to/from a load that is connected to another power supply.

DISCLOSURE OF THE INVENTION

Accordingly, an object of the present invention is to solve the problems and to offer a constant-voltage circuit that is capable of providing a constant voltage that does not cause a problem in transmitting/receiving a signal to/from a load connected to another power supply. In summary, according to the present invention, a current that is proportional to an output current is provided to a part of resistances for output voltage detection, which raises an internal output voltage of the constant-voltage circuit. In this manner, while a voltage drop through a resistance for phase compensation is compensated for, a small capacitor having a small ESR, like a ceramic capacitor, can be used for phase compensation. Further, the low side voltage of the load is made to be equal to the grounding voltage.

MEANS FOR SOLVING THE PROBLEM

The constant-voltage circuit of the present invention for converting an input voltage provided to an input terminal of the constant-voltage circuit into a predetermined constant voltage, and for providing the constant voltage to a load includes:

- a reference voltage generating circuit unit for generating and outputting a predetermined reference voltage;
- an output voltage detecting unit for detecting the constant voltage, and generating and outputting a voltage that is proportional to the detected voltage;
- an output transistor for outputting a current provided from the input terminal to the load according to a control signal;
- an error amplifying circuit unit for providing the control signal for controlling operations of the output transistor so that the proportional voltage become equal to the reference voltage;
- an output current detecting unit for detecting the current output from the output transistor, and generating and outputting the proportional current that is proportional to the detected current;
- a first resistance connected to the output voltage detecting unit;
- a proportional current supply circuit unit for supplying the proportional current that is proportional to the output current from the output current detecting unit to the first resistance;
- a second resistance connected between the output transistor and the load; and
- a capacitor connected to a junction where the second resistance and the load are connected, wherein the second resistance and the capacitor constitute a phase compensating circuit unit for carrying out phase compensation of the error amplifying circuit unit.

According to the constant-voltage circuit of the present invention, a resistance value of the first resistance is set such that a product of the resistance value and the proportional current provided by the output current detecting unit become equal to or less than a voltage drop across the second resistance.

The constant-voltage circuit is arranged such that the output current detecting unit includes a transistor for output current detection for outputting the current from the input terminal that is in proportion to a value of the current output from the output transistor according to the control signal from the error amplifying circuit unit.

The constant-voltage circuit is arranged such that the proportional current supply circuit unit includes a current mirror circuit, to which the current output from the transistor for output current detection is provided.

According to an aspect of the present invention, the proportional current supply circuit unit of the constant-voltage circuit includes a stack type current mirror circuit.

According to an aspect of the present invention, the proportional current supply circuit unit of the constant-voltage circuit includes two current mirror circuits that are cascoded.

According to an aspect of the present invention, the proportional current supply circuit unit of the constant-voltage circuit includes a Wilson type current mirror circuit.

According to an aspect of the present invention, the proportional current supply circuit unit includes:

- an operation amplifying circuit, wherein the output of the output transistor is provided to one of input terminals of the operation amplifying circuit, and the output of the transistor for output current detection is provided to another input terminal of the operation amplifying circuit;
- a current control transistor for controlling the current output from the transistor for output current detection according to an output of the operation amplifying circuit, and for outputting a control current; and
- a current mirror circuit that inputs the control current output by the current control transistor, and for outputting a current proportional to the control current to the first resistance.

According to an aspect of the present invention, the capacitor of the constant-voltage circuit is small, and a ceramic capacitor, for example, is used.

According to an aspect of the present invention, a resistance value of the second resistance in the constant-voltage circuit is set between 50 mΩ and 10 Ω.

According to an aspect of the present invention, the second resistance of the constant-voltage circuit is formed by wiring resistance.

According to an aspect of the present invention, the reference voltage generating circuit unit, the output voltage detecting unit, the output transistor, the error amplifying circuit unit, the output current detecting unit, the first resistance, and the proportional current supply circuit unit are integrated as an IC.

According to an aspect of the present invention, the reference voltage generating circuit unit, the output voltage detecting unit, the output transistor, the error amplifying circuit unit, the output current detecting unit, the first resistance, the proportional current supply circuit unit, and the second resistance are integrated as an IC.

According to an aspect of the present invention, the first resistance of the constant-voltage circuit may be connected between the output transistor and the output voltage detecting unit.

EFFECT OF THE INVENTION

As described above, according to the constant-voltage circuit of the present invention, the internal output voltage of the constant-voltage circuit is raised by a current proportional to the output current to a part of output voltage detection resistances. In this manner, the voltage drop by the resistance prepared for phase compensation is compensated for, and a capacitor having a small internal resistance like a ceramic capacitor can be used for phase compensation. Further, the low side voltage of the load is made equal to the grounding voltage, providing stable signal transfer to and from the load.

BEST MODE FOR CARRYING OUT THE INVENTION

In the following, embodiments of the present invention are described with reference to the accompanying drawings.

First Embodiment

Figure 1:
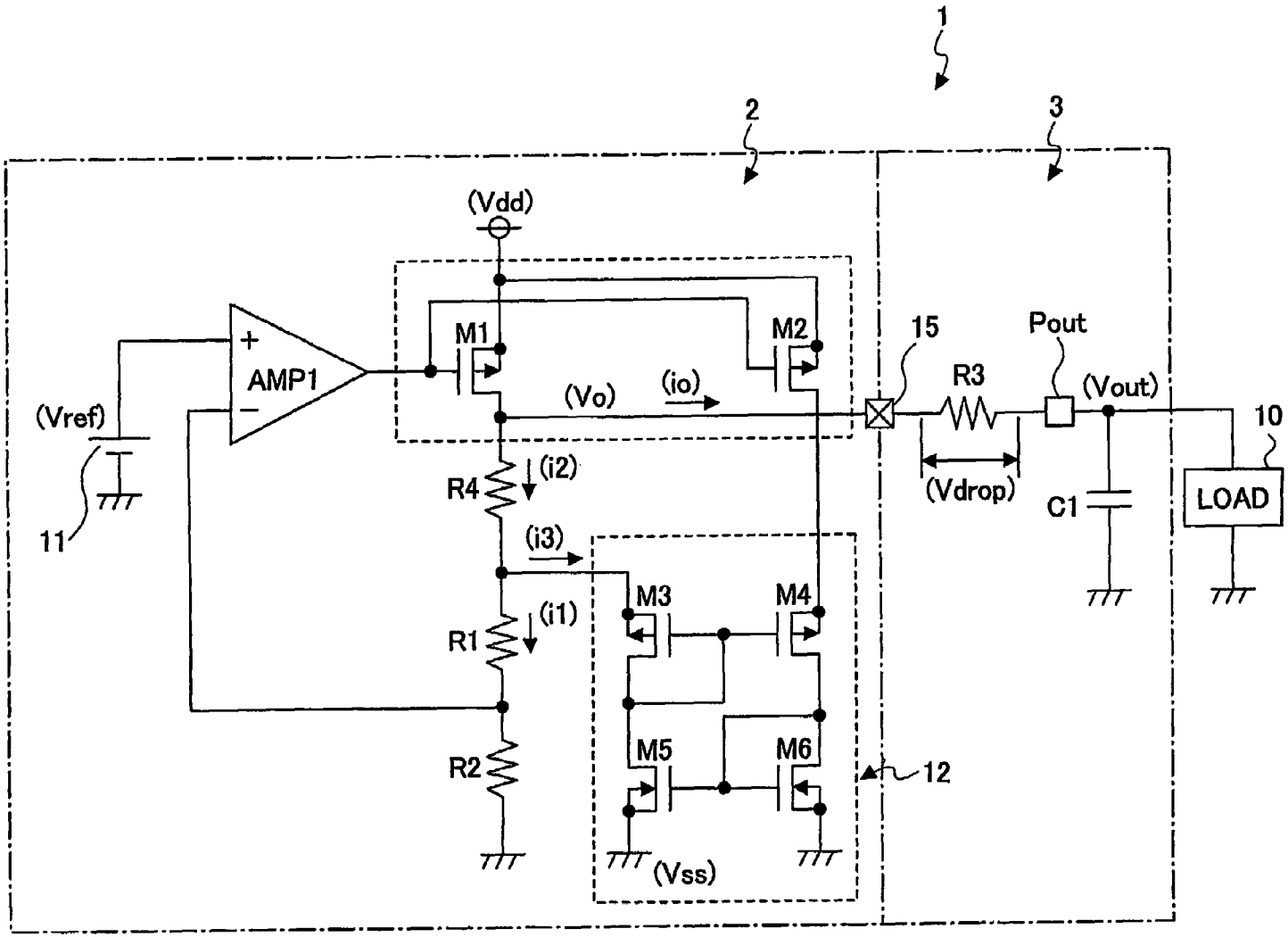
FIG. 1 is an example circuit diagram of a constant-voltage circuit according to a first embodiment of the present invention.

FIG. 1 shows an example of a circuit of a constant-voltage circuit 1 according to the first embodiment of the present invention.

The constant-voltage circuit 1 includes a constant-voltage circuit unit 2 and a phase compensating circuit unit 3. The constant-voltage circuit unit 2 is for generating a predetermined constant voltage from a supply voltage Vdd, and outputs the constant voltage as an internal output voltage Vo. The phase compensating circuit unit 3 includes a resistor R3 and a capacitor C1, and performs phase compensation to the constant-voltage circuit unit 2.

The constant-voltage circuit unit 2 further includes an error amplifying circuit AMP1, a reference voltage generating circuit 11 for generating and outputting a predetermined reference voltage Vref that is provided to a non-inverted input terminal of the error amplifying circuit AMP1, an output transistor M1 that is a PMOS transistor for controlling an output current io that is provided to the phase compensating circuit unit 3 according to a signal output from the error amplifying circuit AMP1, and resistors R1, R2, and R4 for detecting the internal output voltage Vo. Further, the constant-voltage circuit unit 2 includes a transistor M2 that is a PMOS transistor for detecting the output current io, and a current mirror circuit 12. The current mirror circuit 12 includes PMOS transistors M3 and M4, and NMOS transistors M5 and M6.

In addition, the reference voltage generating circuit 11 serves as the reference voltage generating circuit unit, the error amplifying circuit AMP1 serves as an error amplifying circuit unit, and the resistors R1 and R2 serve as an output voltage detecting unit. Further, the transistor M2 serves as an output current detecting unit, the resistor R4 serves as a first resistance, the current mirror circuit 12 serves as a proportional current supply circuit unit, and the resistor R3 serves as a second resistance.

The inverted input terminal of the error amplifying circuit AMP1 is connected to a connection point where the resistors R1 and R2 are connected, and the output terminal of the AMP1 is connected to the gate of the output transistor M1. The output transistor M1 is connected between the supply voltage Vdd, which is an input voltage, and an output pad 15, called an IC pad 15, of the IC, the IC pad 15 being the output terminal of the constant-voltage circuit unit 2. The resistors R4, R1, and R2 are connected in series between the drain of the output transistor M1, and the grounding voltage. The gate of the output transistor M1 is connected to the output terminal of the error amplifying circuit AMP1. As for the transistor M2 for output current detection, the source is connected to the supply voltage Vdd.

Between the drain of the transistor M2 for output current detection, and the grounding voltage, the PMOS transistor M4 and the NMOS transistor M6 are connected in series, and the PMOS transistor M3 and the NMOS transistor M5 are connected in series between the connection point of the resistors R4 and R1, and the grounding voltage. The gate of the PMOS transistor M3 and the gate of the PMOS transistor M4 are connected, and the connection point thereof is connected to the drain of the PMOS transistor M3. Further, the gate of the NMOS transistor M5 and the gate of the NMOS transistor M6 are connected, and the connection point thereof is connected to the drain of the NMOS transistor M6.

In the configuration as described above, the error amplifying circuit AMP1 controls the gate voltage of the output transistor M1 so that the voltages of the input terminals of the error amplifying circuit AMP1 become equal to each other. Accordingly, the internal output voltage Vo of the constant-voltage circuit unit 2 when the output current io is zero is expressed by the following formula (1). Here in the formula (1), R1, R2, and R4 represent resistance values of the resistors R1, R2, and R4, respectively.

$$Vo = Vref \times (R4 + R1 + R2)/R2 \quad (1)$$

The internal output voltage Vo is provided from the output terminal Pout of the IC through the IC pad 15 and the fixed resistor R3 for phase compensation. Between the output terminal Pout of the IC and the grounding voltage, a load 10 is connected with a capacitor C1 for phase compensation in parallel.

Since the fixed resistor R3 for phase compensation is provided in the IC, a ceramic capacitor having a small ESR can serve as the capacitor C1.

However, as the output current io increases, a voltage drop Vdrop increases across the fixed resistor R3 for phase compensation, and the voltage Vout of the output terminal Pout is decreased accordingly. The transistor M2 for output current detection, the current mirror circuit 12, and the resistor R4 constitute a circuit for compensating for the voltage drop Vdrop.

The gates of the transistor M2 and the transistor M1 are connected, and the sources of the transistor M2 and the transistor M1 are connected, constituting a current mirror circuit. The drain current of the transistor M2 is set at, e.g., between 1/10000 and 1/1000 of the drain current of the transistor M1.

The drain current of the transistor M2 is provided to the current mirror circuit 12, the channel length modulation effect of which is improved. Although the current mirror circuit 12 shown in FIG. 1 is constituted by a stack type circuit, a cascading current supply, a Wilson type current mirror circuit, and the like may be used.

An output current i3 of the current mirror circuit 12 is taken out as the source current of the PMOS transistor M3. If the mirror current ratio of the current mirror circuit 12 is set at 1:1, the source current i3 of the PMOS transistor M3 becomes equal to the drain current of the transistor M2 for output current detection. (Note: Output current i3 is output as viewed from transistor M1, but input as viewed by transistor M3. This is okay as translated.)

Since the source of the PMOS transistor M3 is connected to the connection point of the resistor R4 and the resistor R1, the source current i3 of the PMOS transistor M3 flows through the resistor R4, and a voltage drop equal to the resistance of R4×i3 is generated across the resistor R4. (Note: You are correct that i2=i3+i1, but i3 is the part that is changing. The translation is good)

Consequently, since the voltage drop across the resistor R4 increases as the output current io increases, the internal output voltage Vo of the constant-voltage circuit unit 2 is raised, and the voltage drop Vdrop generated by the resistor R3 for phase compensation can be compensated for.

This situation is further explained using the following formulas. Here, in each formula, R1 through R4 represent resistance values of the resistors R1 through R4, respectively.

The internal output voltage Vo of the constant-voltage circuit unit 2 is expressed by the following formula (2).

$$Vo=Vref\times(R4+R1+R2)/R2+R4\times i3 \quad (2)$$

Further, the voltage Vout of the output terminal Pout is expressed by the following formula (3).

$$Vout=Vo-R3\times io \quad (3)$$

By substituting the formula (2) into the formula (3), the following formula (4) is obtained.

$$Vout=Vref\times(R4+R1+R2)/R2+R4\times i3-R3\times io \quad (4)$$

In reference to the formula (4), a condition that makes R4×i3−R3×io=0 provides an ideal voltage compensation.

Accordingly, the condition is R4×i3=R3×io.

Provided that io/i3=A (A is a constant), the condition is that R4=A×R3. That is, the condition is that the resistance of the resistor R4 be A times of the resistance of the resistor R3. However, if R4×i3 becomes greater than R3×io, positive feedback starts. Accordingly, the value of the constant A is usually set equal to or smaller than io/i3.

Figure 2:
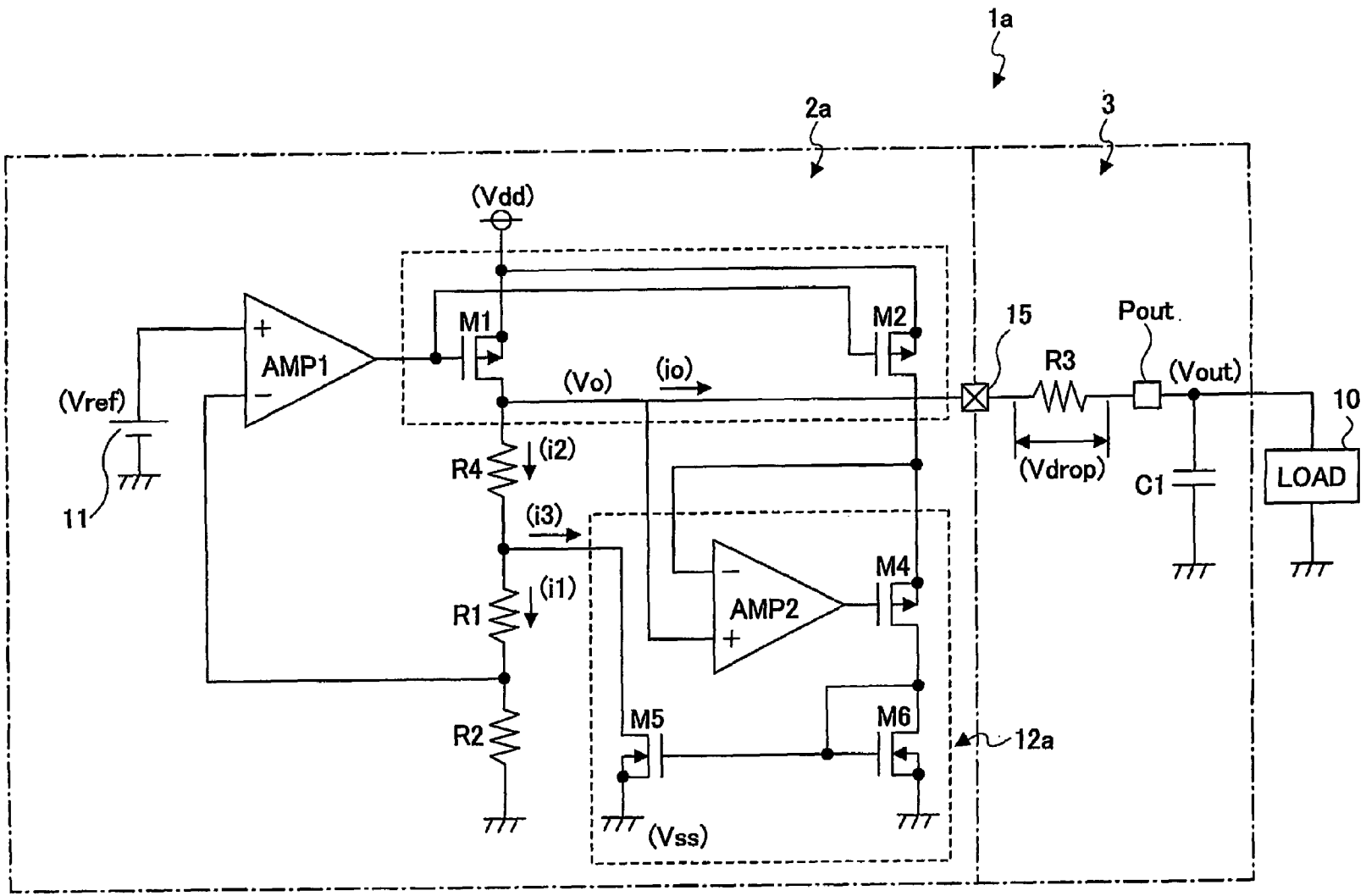
FIG. 2 is another example circuit diagram of the constant-voltage circuit according to the first embodiment of the present invention.
Figure 3:
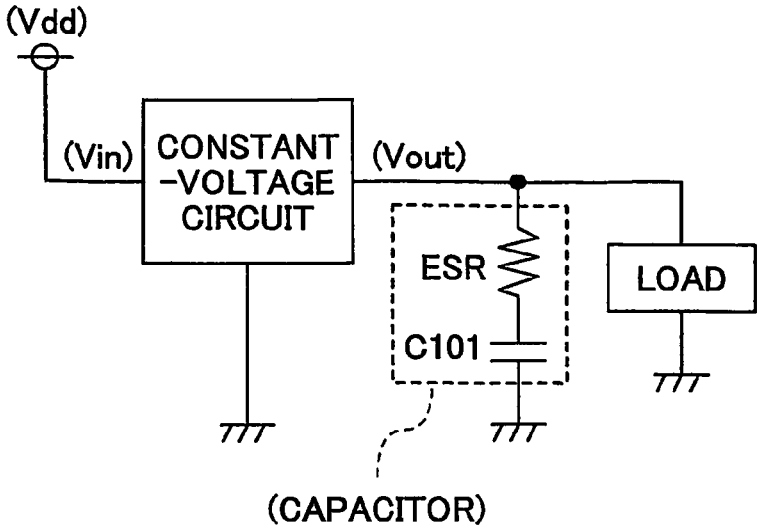
FIG. 3 is an example circuit diagram of a conventional constant-voltage circuit.
Figure 4:
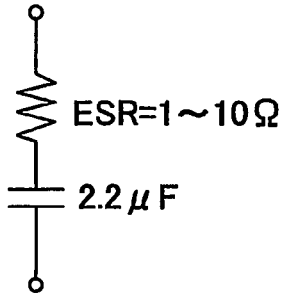
FIG. 4 shows an example of an equivalent circuit of a tantalum capacitor.
Figure 5:
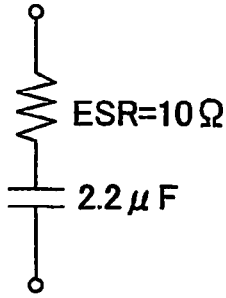
FIG. 5 shows an example of an equivalent circuit of a ceramic capacitor.
Figure 6:
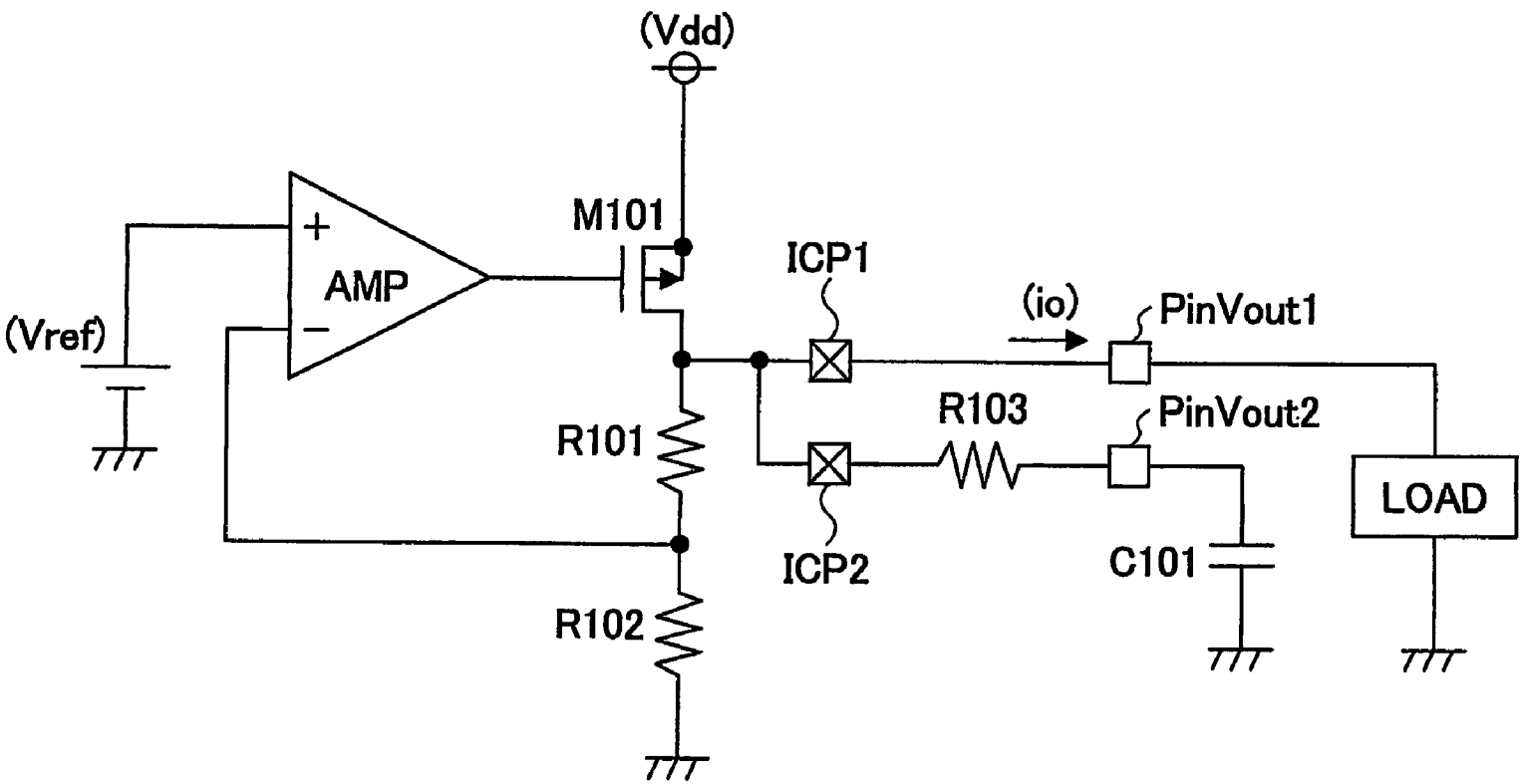
FIG. 6 is an example circuit diagram of a conventional constant-voltage circuit.
Figure 7:
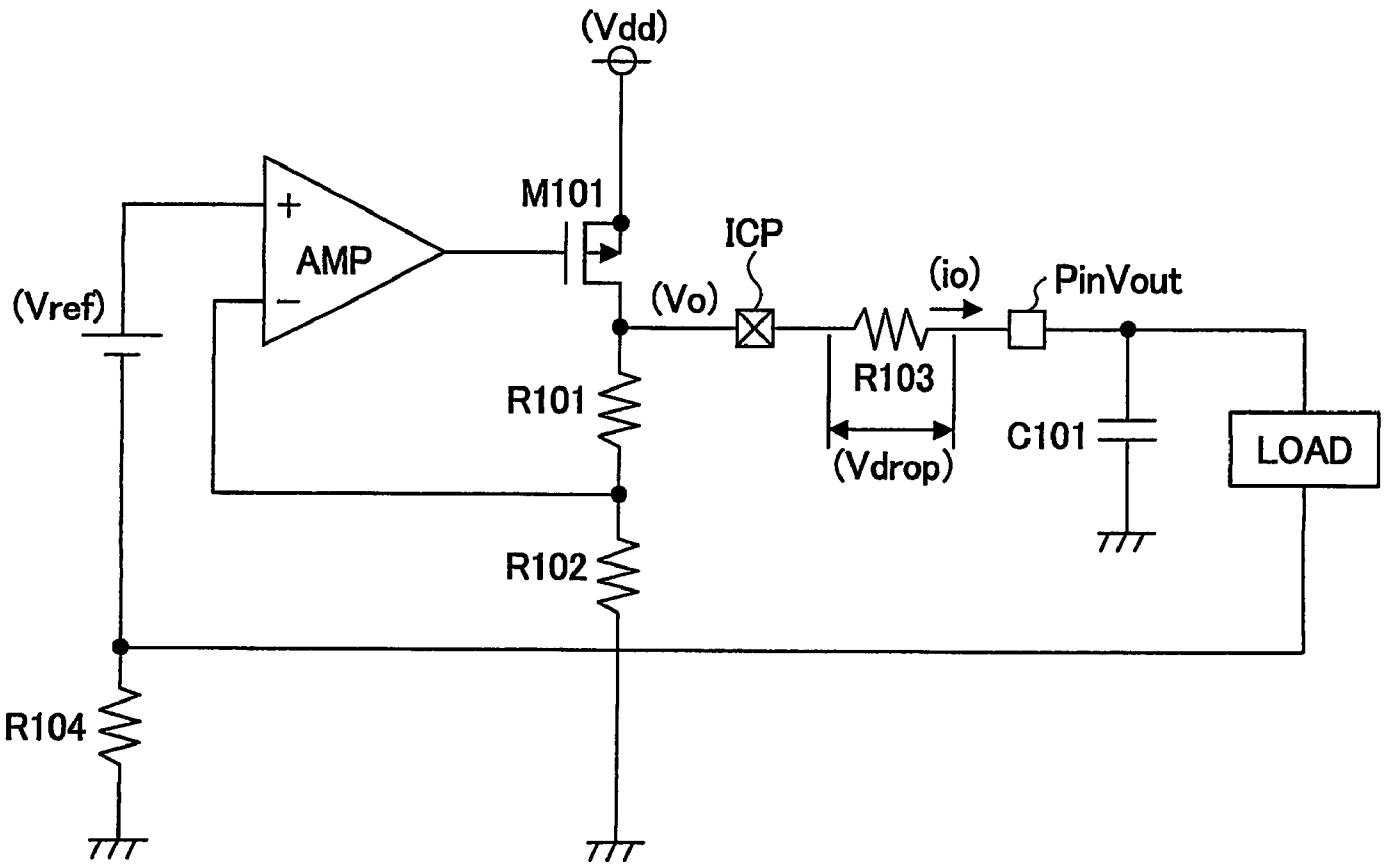
FIG. 7 is an example circuit diagram of another conventional constant-voltage circuit.

FIG. 2 shows another example circuit of a constant-voltage circuit 1*a* according to the first embodiment of the present invention. Here in FIG. 2, the components the same as in FIG. 1 are given the same reference marks, and explanations thereof are not repeated, but differences are described in the following.

The differences include that the current mirror circuit 12 of FIG. 1 is replaced by a current mirror circuit 12*a*. The PMOS transistor M3 of the current mirror circuit 12 is not used in the current mirror circuit 12*a*, wherein an operation amplifying circuit AMP2 is added, and the transistors M5 and M6 constitute a single-stage current mirror circuit. In this connection, the constant-voltage circuit unit is referred to as the constant-voltage circuit unit 2*a*, and the constant-voltage circuit is referred to as the constant-voltage circuit 1*a* in FIG. 2.

With reference to FIG. 2, the constant-voltage circuit 1*a* includes the constant-voltage circuit unit 2*a* and the phase compensating circuit unit 3. The constant-voltage circuit unit 2*a* is for generating a predetermined constant voltage from the supply voltage Vdd, which is an input voltage, and outputs the constant voltage as the internal output voltage Vo. The phase compensating circuit unit 3 performs phase compensation for the internal output voltage Vo output from the constant-voltage circuit unit 2*a*, and supplies the phase-compensated voltage to the load 10.

The constant-voltage circuit unit 2*a* includes the reference voltage generating circuit 11, the error amplifying circuit AMP1, the output transistor M1, the resistors R1, R2, and R4 for output voltage detection, the transistor M2 for output current detection, and the current mirror circuit 12*a*. The current mirror circuit 12*a* includes the operation amplifying circuit AMP2, the PMOS transistor M4, and the NMOS transistors M5 and M6. In addition, current mirror circuit 12*a* serves as the proportional current supply circuit unit, and the PMOS transistor M4 serves as a current control transistor.

Between the drain of the transistor M2 for output current detection, and the grounding voltage, the PMOS transistor M4 and the NMOS transistor M6 are connected in series, and the NMOS transistor M5 is connected between the connection point of the resistors R4 and R1, and the grounding voltage. The gate of the PMOS transistor M4 is connected to the output terminal of the operation amplifying circuit AMP2, the internal output voltage Vo is provided to the non-inverted input terminal of the operation amplifying circuit AMP2, and the source of the PMOS transistor M4 is connected to the inverted input terminal of the operation amplifying circuit AMP2. Further, the gate of the NMOS transistor M5 and the gate of the NMOS transistor M6 are connected, and the connection point is connected to the drain of the NMOS transistor M6.

In a such configuration, the drain current of the PMOS transistor M4 serves as the input current for the current mirror circuit constituted by the NMOS transistors M5 and M6, and the current mirror circuit provides the drain current of the NMOS transistor M5 to the resistor R4. (Note: Yes, the wording is strange but the arrow is correct.)

In this way, the current mirror circuit constituted by the NMOS transistors M5 and M6 is inserted in the feedback loop of the operation amplifying circuit AMP2. Accordingly, the current mirror circuit 12*a* controls the gate voltage of the PMOS transistor M4 so that the drain voltage of the output transistor M1 and the drain voltage of the transistor M2 for output current detection are made equal. For this reason, precision of the current of the current mirror circuit 12 can be further raised as compared with the case shown by FIG. 1.

As described above, the constant-voltage circuit according to the first embodiment of the present invention is capable of compensating for not only the voltage drop across the resistor R3 for phase compensation connected to the IC pad 15, but also a gain fall of the error amplifying circuit AMP1, and a voltage drop by a wiring resistance from the constant-voltage circuit unit 2 to the load 10.

Further, the present invention is not limited to these embodiments, but various variations and modifications may be made without departing from the scope of the present invention.

What is claimed is:

1. A constant-voltage circuit for converting an input voltage provided to an input terminal of said constant-voltage circuit into a predetermined constant voltage, and for providing said constant voltage to a load, comprising:

a reference voltage generating circuit unit for generating and outputting a predetermined reference voltage;

an output voltage detecting unit for detecting said constant voltage, and generating and outputting a voltage that is proportional to said detected voltage;

an output transistor for outputting a current provided from said input terminal to said load according to a control signal;

an error amplifying circuit unit for providing said control signal for controlling operations of said output transistor so that said proportional voltage becomes equal to said reference voltage;

an output current detecting unit for detecting said current output from said output transistor, and generating and outputting a proportional current that is proportional to the detected current;

a first resistance connected to said output voltage detecting unit;

a proportional current supply circuit unit for supplying said proportional current, which is proportional to the output current, from said output current detecting unit to said first resistance;

a second resistance connected between said output transistor and said load; and a capacitor connected to a junction where said second resistance and said load are connected; wherein said second resistance and said capacitor constitute a phase compensating circuit unit for carrying out phase compensation for said error amplifying circuit unit.

2. The constant-voltage circuit as claimed in claim 1, wherein a resistance value of said first resistance is set such that a product of the resistance value and said proportional current provided by said output current detecting unit becomes equal to or less than a voltage drop through said second resistance.

3. The constant-voltage circuit as claimed in claim 1, wherein said output current detecting unit comprises a transistor for output current detection for outputting said proportional current that is proportional to the current output from said output transistor according to the control signal from said error amplifying circuit unit using a current provided to said input terminal.

4. The constant-voltage circuit as claimed in claim 3, wherein said proportional current supply circuit unit comprises a current mirror circuit, to which the current output from the said transistor for output current detection is provided.

5. The constant-voltage circuit as claimed in claim 4, wherein said proportional current supply circuit unit comprises a stack type current mirror circuit.

6. The constant-voltage circuit as claimed in claim 4, wherein said proportional current supply circuit unit comprises two current mirror circuits that are cascaded.

7. The constant-voltage circuit as claimed in claim 4, wherein said proportional current supply circuit unit comprises a Wilson type current mirror circuit.

8. The constant-voltage circuit as claimed in claim 4, wherein said proportional current supply circuit unit comprises:

an operation amplifying circuit, wherein the output of said output transistor is provided to one of input terminals of the operation amplifying circuit, and the output of said transistor for output current detection is provided to another input terminal of the operation amplifying circuit;

a current control transistor for controlling the current output from said transistor for output current detection according to an output of said operation amplifying circuit, and for outputting a control current; and a current mirror circuit that inputs said control current output by said current control transistor, and for outputting a current proportional to said control current to said first resistance.

9. The constant-voltage circuit as claimed in claim 1, wherein an internal resistance of said capacitor is small.

10. The constant-voltage circuit as claimed in claim 7, wherein said capacitor is a ceramic capacitor.

11. The constant-voltage circuit as claimed in claim 1, wherein a resistance value of said second resistance is between 50 mΩ and 10 Ω.

12. The constant-voltage circuit as claimed in claim 1, wherein said second resistance is formed by wiring resistance.

13. The constant-voltage circuit as claimed in claim 1, wherein said reference voltage generating circuit unit, the output voltage detecting unit, the output transistor, the error amplifying circuit unit, the output current detecting unit, the first resistance, and the proportional current supply circuit unit are integrated as an IC.

14. The constant-voltage circuit as claimed in claim 1, wherein said reference voltage generating circuit unit, the output voltage detecting unit, the output transistor, the error amplifying circuit unit, the output current detecting unit, the first resistance, the proportional current supply circuit unit, and the second resistance are integrated as an IC.

15. The constant-voltage circuit as claimed in claims 1, wherein said first resistance is connected between said output transistor and said output voltage detecting unit.

* * * * *